US008556696B2

(12) United States Patent
Hoyt et al.

(10) Patent No.: US 8,556,696 B2
(45) Date of Patent: Oct. 15, 2013

(54) SYSTEM AND METHOD FOR PUZZLE SOLVING UTILIZING LETTER AND VISUAL REPRESENTATIONS

(76) Inventors: David L. Hoyt, Chicago, IL (US); Stephen Bullock, Chapel Hill, NC (US); James Keifer, Manhattan Beach, CA (US); Kathleen Keifer, Manhattan Beach, CA (US)

( * ) Notice: Subject to any disclaimer, the term of this patent is extended or adjusted under 35 U.S.C. 154(b) by 29 days.

(21) Appl. No.: 13/240,757

(22) Filed: Sep. 22, 2011

(65) Prior Publication Data

US 2012/0071220 A1 Mar. 22, 2012

Related U.S. Application Data

(60) Provisional application No. 61/385,372, filed on Sep. 22, 2010.

(51) Int. Cl.
*A63F 9/24* (2006.01)

(52) U.S. Cl.
USPC ..... 463/11; 463/31

(58) Field of Classification Search
USPC ..... 463/11, 31
See application file for complete search history.

(56) References Cited

U.S. PATENT DOCUMENTS 6,935,945 B2 8/2005 Orak

*Primary Examiner* — Omkar Deodhar
(74) *Attorney, Agent, or Firm* — Jeffrey A. Pine; Dykema Gossett PLLC

(57) ABSTRACT

A method and system for providing a puzzle game containing an answer category clue, a letter grid containing multiple letters, numbers or characters, an image, and an answer grid which contains blanks for each letter that will be used to fill-in the correct answer. The game allows a letters from the letter grid to be selected and automatically placed onto the answer grid. Points are awarded if the letter selected is the next available blank in the answer grid. As the player selects a letter from the letter grid, that letter disappears and a portion of an image appears. As additional letters are removed from the letter grid, additional portions of the image are displayed, which provides another clue for the solution to the puzzle.

20 Claims, 11 Drawing Sheets

SYSTEM AND METHOD FOR PUZZLE SOLVING UTILIZING LETTER AND VISUAL REPRESENTATIONS

PRIORITY STATEMENT

This application claims the benefit of U.S. Provisional Application 61/385,372 filed Sep. 22, 2010.

FIELD OF THE INVENTION

The present invention pertains to a system and method for solving a puzzle using clues, letters and a visual representation, and more particularly, the invention relates to solving the answer to a puzzle, in which the answer is in a category, and as letters or numbers are chosen, the player can more easily determine the visual representation or image.

BACKGROUND OF THE INVENTION

Solving word puzzles by placing the correct letters into an answer grid has been around for many years. Examples of such games include the children's game Hangman and the television game show Wheel Of Fortune. In those examples, a player guesses a letter, which if correct is added to the puzzle grid until the player recognizes the solution to the puzzle. In some of these types of games, a player is only allowed a certain number of guesses before the puzzle must be solved. In other embodiments, players play the game against others, one at a time, guessing letters to determine who can solve the puzzle first. Currently, there are no games that provide an answer category clue and then incorporate the determining and deducing of letters or numbers to solve the puzzle, while providing an increasingly-apparent visual clue as the letters or numbers are removed from the grid, thereby providing an additional clue to solve the puzzle.

SUMMARY OF THE INVENTION

The present invention includes a method and system for providing a game or puzzle, the solution of which is in a particular answer category, which is provided to the player as a clue. The player is also provided a letter grid containing multiple letters (or numbers or characters) and an answer grid which contains blanks for each letter that will be used to fill-in the correct answer. The object of the game is to place each of the letters from the letter grid onto the answer grid, usually in the correct order, to complete the answer grid and the puzzle. As the player selects a letter from the letter grid, that letter disappears and a portion of an image appears. As additional letters are removed from the letter grid, additional portions of the image are displayed. The image is another clue to used for the solution to the puzzle. As the image is revealed, the player will have a better chance to solve the puzzle.

Points can be awarded during the game play. Since the object is to guess the correct letters for the solution in the correct order, in the preferred embodiment, if the player correctly guesses the letter for the next available blank (shown with a question mark), maximum points are awarded. Less points, or no points are awarded for guessing a correct letter, but in the wrong order. Further, in an alternative embodiment, the player may have a limited amount of time to complete the puzzle or in yet another embodiment, the player may be asked to guess the next available blank (as described above), but the player will only be allowed a predefined number of chances to select the correct letter correctly before the game is ended prematurely.

The present invention can be a feature of or on virtually any game on any platform, including but not limited to board games, online games, download games, mobile phone games, game shows, and even lottery tickets and slot machines.

The present invention can be used by itself or in connection with additional games, and can even be used as, or used with a bonus game feature. There may be a bonus, for example for quickly and properly locating a letter on the answer grid, the faster the correct answer is placed, the higher the bonus amount. Further, the question mark used to indicate where the letter is to be placed, may be randomly placed on a blank on the answer grid, so that even if the player has solved the puzzle (and is merely filling in the grid), it may take some time to determine which letter belongs in the particular (random) location.

An objective of the present invention is to provide a puzzle game that uses an answer category clue, a letter grid and an answer grid, along with the systematic display of an image clue, to allow a player to determine the solution to the puzzle.

Another object of the present invention is to provide a puzzle game that uses an answer category clue, a letter grid, an answer grid, and the systematic display of an image clue, to allow a player to determine the solution to the puzzle while obtaining points for guessing the correct letters from the letters grid.

Another object of the present invention is to provide a puzzle game that uses an answer category clue, a letter grid, an answer grid, and the systematic display of an image clue, to allow a player to determine the solution to the puzzle while obtaining points for guessing the correct letters from the letters grid in the correct order.

Another object of the present invention is to provide a puzzle game that uses an answer category clue, a letter grid, an answer grid, and the systematic display of an image clue, to allow a player to determine the solution to the puzzle while obtaining points for guessing the correct letters from the letters grid in the correct order within a predetermined time.

Another object of the present invention is to provide a puzzle game that uses an answer category clue, a letter grid, an answer grid, and the systematic display of an image clue, to allow a player to determine the solution to the puzzle as a board game, online game, download game, mobile phone game, television game show, lottery ticket and slot machine.

Another object of the present invention is to provide a puzzle game that uses an answer category clue, a letter grid, an answer grid, and the systematic display of an image clue, to allow a player to determine the solution to the puzzle as a bonus round to an existing game.

Other objects and advantages of the present invention will become apparent to one having ordinary skill in the art after reading the specification in light of the drawing figures, however, the spirit and scope of the present invention should not be limited to the description of the embodiments contained herein.

DETAILED DESCRIPTION OF EMBODIMENTS OF THE INVENTION

The present invention provides a method and system for providing a game or game puzzle, the solution for which matches a particular answer category clue. A player is provided a letter grid containing multiple letters and an answer grid which contains blanks for each letter that will be used to fill-in the correct answer. The present invention is not necessarily limited to letters as the solution to a puzzle may contain some or all numbers or non-alphanumeric characters.

In the preferred embodiment, the object of the game is to place or locate each of the letters displayed on the letter grid onto the answer grid in the correct order, to complete the answer grid and the puzzle. As the player selects a letter from the letter grid, that letter disappears off of the letter grid and leaves a portion of the letter grid displaying a portion of an image. The image can be any sort of pictorial or graphical display, including photographs, drawings, advertisements, graphic designs, logos and any other type of display. Further, the image can be a motion or moving picture taken from computer memory, YouTube, or any other source.

As additional letters are selected and removed from the letter grid, additional portions of the image will be displayed. The image, as it is further displayed, will be another clue to be used to solve the puzzle. As the image is further revealed, the player will determine what the actual image is thereby increasing the chance to solve the puzzle.

Figure 1:
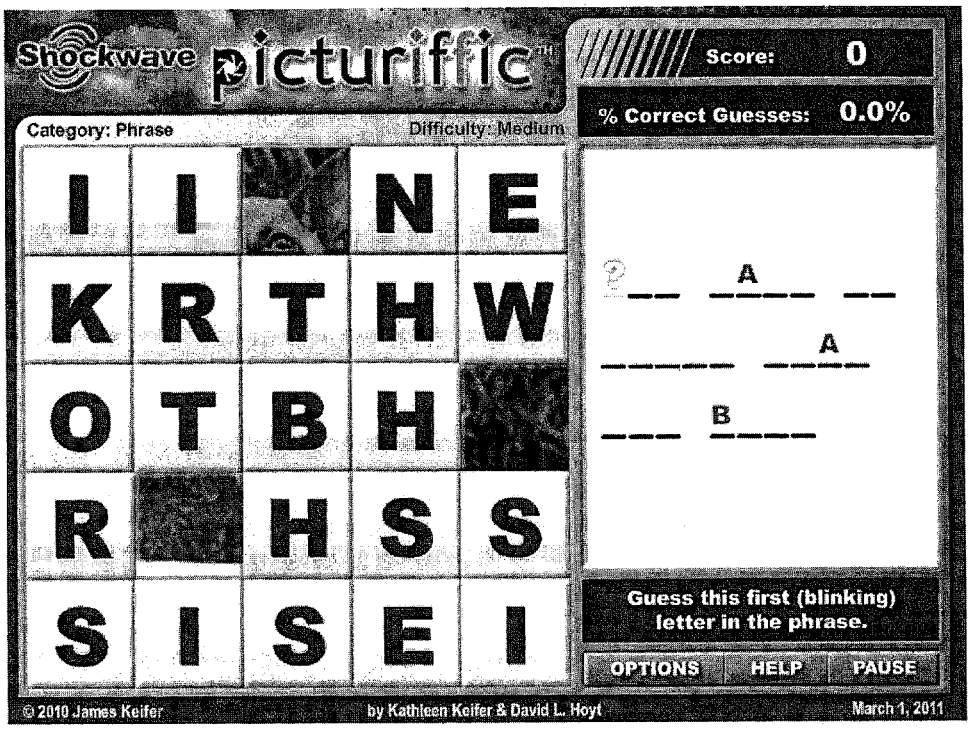
FIG. 1 shows a puzzle game in accordance with an embodiment of the present invention at the start of the game.
Figure 1:
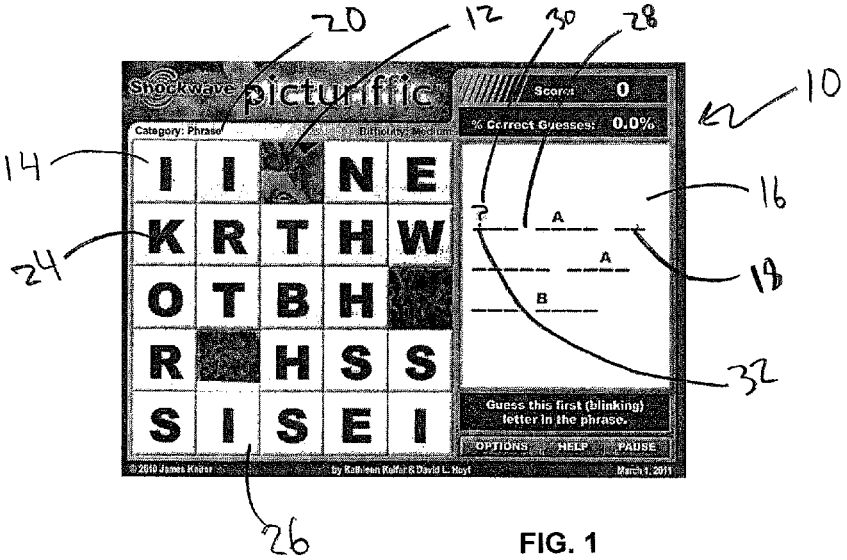
Figure 23:
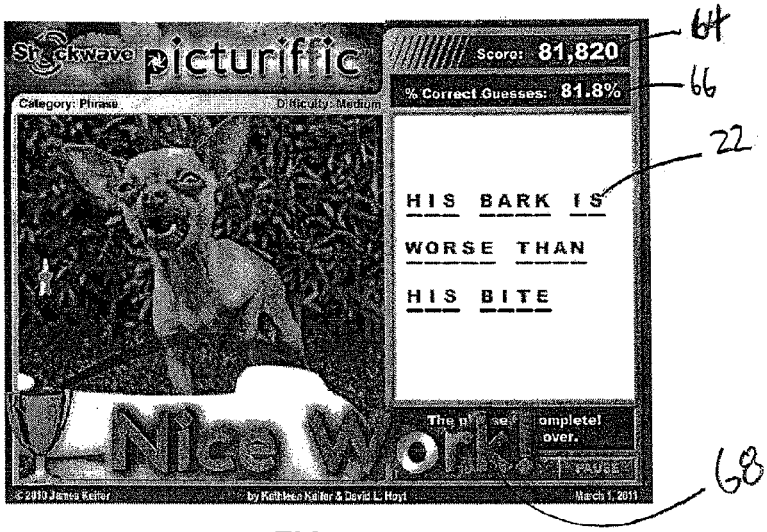
FIG. 23 shows a puzzle game in accordance with an embodiment of the present invention as the game finishes.
Figure 24:
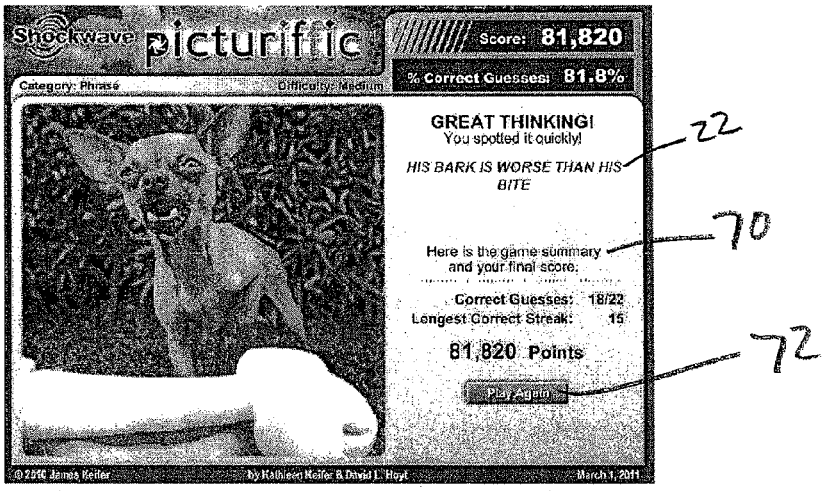
FIG. 24 shows a puzzle game in accordance with an embodiment of the present invention after the game is completed.

The present invention is shown in FIG. 1 as the puzzle game 10 at the beginning of the game play, containing an image 12 (only a portion shown), a letter grid 14, an answer grid 16 containing blanks 18, an answer category clue 20, and a mystery answer 22 (see FIGS. 23 and 24). The image 12 may be a photograph, or a drawing, a graphic or a visual representation of virtually anything. The letters 24 on the letter grid 14, which may include numbers or non-alphanumeric characters, in part or in total, are each affixed to a shape 26, such as squares, rectangles or any other shape, with one letter 24 on each shape 26. There are no upper or lower limits to the quantity of letters 24 in the letter grid 14.

Although the beginning of the game play in the preferred embodiment shows the puzzle game 10 with a few letters 24 removed from the letter grid 14, this is not necessary to begin the game. The letter grid 14 can be completely filled, with no letters 24 in the answer grid 16. Placing a few letters 24 in the answer grid 16 and showing a portion of the image 12, increases the player's chance of guessing the correct letter 24 at the beginning of the mystery answer 22.

The mystery answer 22 is a word, phrase or series of words that match the answer category clue 20. Some examples of mystery answers 22 include well-known phrases, descriptions of the image, statements of fact, humorous observations, names of a location, names of notable people, a word translated in two languages, famous quotes, advertising slogans, movie titles, etc. It can be seen that almost any word or group of words can be used as the mystery answer 22.

The answer category clue 20 is a description relating to the mystery answer 22, and there are no predefined limits on the types of answers 22 for the present invention. Examples of answer category clues 20 and thus the types of answers 22 which they describe include: "Funny Phrase", "Statement of Fact", "What are You Looking At?", "Song Lyrics", "Movie Star and Title", "Famous Place", "Popular Saying".

The game play for the present invention begins with the letters 24 on the letter grid 14 covering some portion of the image 12. The letters 24 may cover the entire image 16 so that no portion of it is visible at the game's beginning. In the preferred embodiment some portions of the image 12 remain uncovered at the game's beginning so that the game player can see these image 16 portions. When the letters 24 are affixed to rectangular or square shapes 26, they usually form a regular letter grid 14 covering the image 12.

The letters 24 in the letter grid 14, which cover the image 12 (until selected), include all or some of the letters 24 in the mystery answer 22. For example, if the mystery answer is "a bird in the hand is worth two in the bush", then the letter grid 14 might have 33 letters 24. However, the letter grid 14 may also have 50 letters, some of which will not be used in that example. Also, the letter grid 14 might only contain 20 letters 24, since a certain letters 24 are used multiple times in that particular mystery answer 22. In that last example, the portion of the image 12 may not be shown until the particular letter 24 is selected for the last time.

In the preferred embodiment, the game 10 begins with multiple blanks 18 indicating where the mystery answer 22 will be located when the puzzle is completed. These blanks or letter position marks 18 may be indicated as graphic lines, strokes, rectangular outlines or underscores (as shown in the figures). When several letter position marks 18 represent a single word, they are grouped together with no space between the letter position marks 18. When the mystery answer 22 is composed of two or more words, the groupings of letter position marks 18 are separated by an extra space 28. When the mystery answer 22 contains punctuation, such as quotation marks, dashes, commas, periods or apostrophe marks, these punctuation marks are shown in proper position within, between, before or after the letter position marks 18 representing the mystery answer 22.

When the game begins and the mystery answer 22 representation of blanks 18 is first displayed on the puzzle 10. This representation will contain any and all punctuation and indicate the different words of the mystery answer 22 with spaces 28. In addition, the mystery answer 22 representation may contain one, several or many blanks 18 filled-in with letters 24 representing a portion of the correct mystery answer 22. The game can fill-in these letters 24 in a number of ways, including displaying the letter 24 over the blank 18 (shown), replacing the blank 18 with the letter 24 entirely (not shown), or changing colors of either the blank 18, the letter 24, or the area in which the letter is displayed (not shown), among other ways. These filled-in letters (or numbers) are thus in their correct position within the word or words of the mystery answer 22 and provide the player with assistance towards determining the correct mystery answer 22.

The letter 24 positions of the mystery answer 22 which are not filled-in at the start of the game (and which are shown with letter position marks or blanks 18) represent the assortment of letters and numbers 24 which initially cover all or a portion of the image 12. If there are exactly "X" number of letter position marks 18 in the mystery answer 22 which are not filled-in, then there are exactly the same "X" number of letters or numbers 24 covering the image 12.

The game 10 is played by selecting one letter or number 24 at a time from the letter grid 14 on top of the image 12. That letter 24 will automatically be placed in the proper location in the mystery answer 22 on the answer grid 16, however, the object in the preferred embodiment, is to correctly select the letter or number 24 that belongs to the blank 18 where an indicator 30, such as a question mark is located. As the letter or number 24 is removed from the letter grid 14, its removal reveals a new portion of the image 12 to the player allowing the player to better understand the contents or meaning of the image 12. In the preferred embodiment, points are given to the player for selecting the letter 24 that belongs where the indictor 30 is located.

The actual, entire mystery answer 22 relates to the image 12 and the answer category 20 provides both guidance and description of how the image 12 and the word or words of the mystery answer 22 relate to one another.

As described above, the player is attempting to score the highest number of points while trying to figure out the answer 22. Points are scored by selecting the letter 24 that goes under the indicator or question mark symbol 30. Points can also be reduced for incorrect selections (either because the selection did not fill the next available blank, or if the selection is not in the mystery answer 22). In the preferred embodiment, the question mark symbol 30 is always in the first open blank 32 in the answer 22.

Any letter 24 that the player selects is placed into its proper position in the answer 22, but the player only scores points when the correct letter 24 that belongs in the space under the question mark 30 is selected. Other embodiments for scoring can provide points even if the selection is not for the next blank 32.

The player may select letter 24 from the letter grid 14 or it can be selected by typing on a keyboard or keypad, or even through voice activation.

Figure 2:
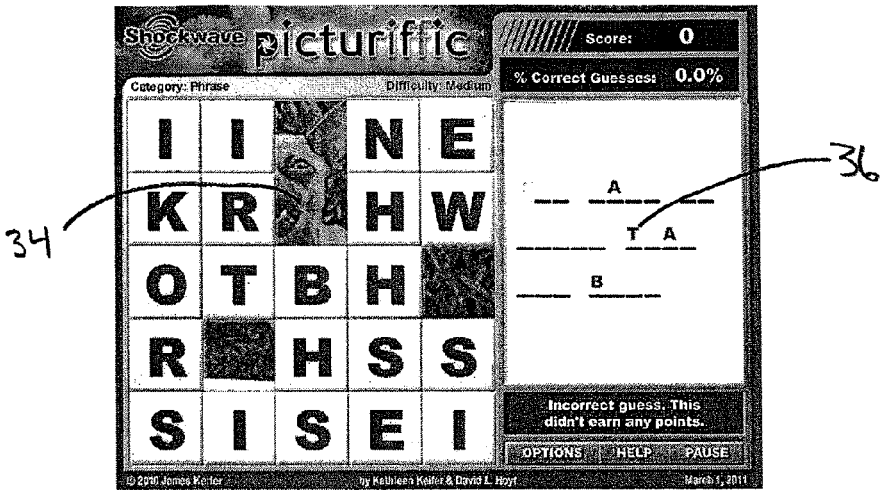
FIG. 2 shows a puzzle game in accordance with an embodiment of the present invention as the game continues.

The following describes an example of a game being played out in the preferred embodiment using a one letter 24 selection at a time. FIG. 1 shows an example screen shot displayed to a player when the game begins. The player attempts to select the letter 24 that belongs on the first blank 32 where the question mark 30 is located. In FIG. 2, the player has selected the letter T in the middle of the second row. The T has been removed indicating an additional portion 34 of the image 12. However, the letter T is not the correct selection for the first blank 32 in this case, and instead, the T is displayed or located over a blank 36 where it correctly belongs on the answer grid 16.

Figure 3:
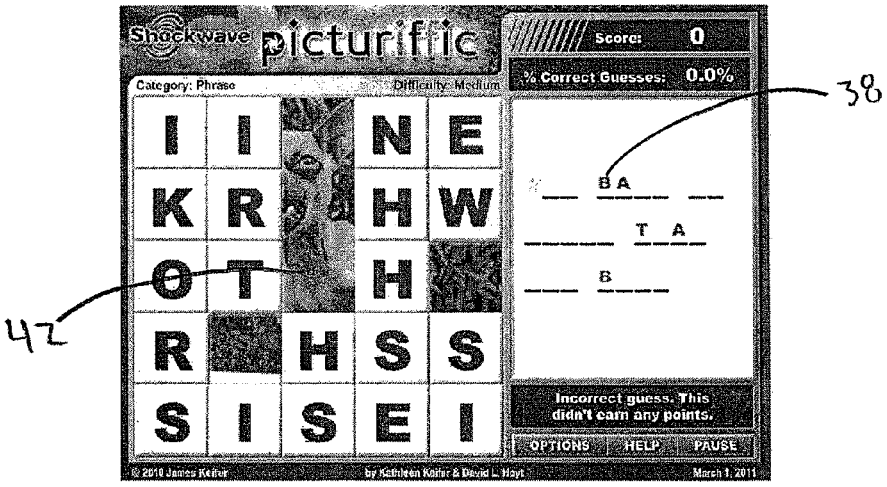
FIG. 3 shows a puzzle game in accordance with an embodiment of the present invention as the game continues.
Figure 4:
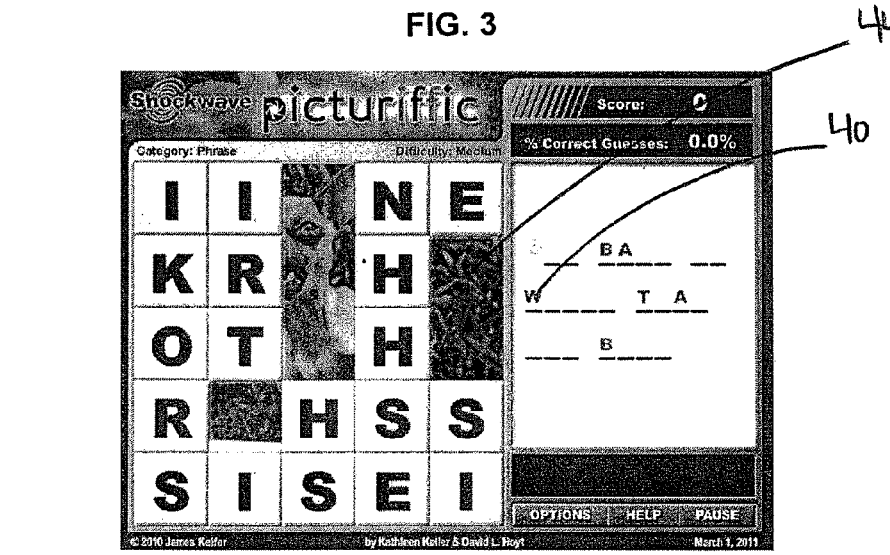
FIG. 4 shows a puzzle game in accordance with an embodiment of the present invention as the game continues.

FIGS. 3 and 4 indicate additional incorrect selections of the letters B and W, which are indicated in their respective correct locations 38, 40 on the answer grid 16. The portions of the image 12 where the B and W were selected from are now shown 42, 44.

Figure 5:
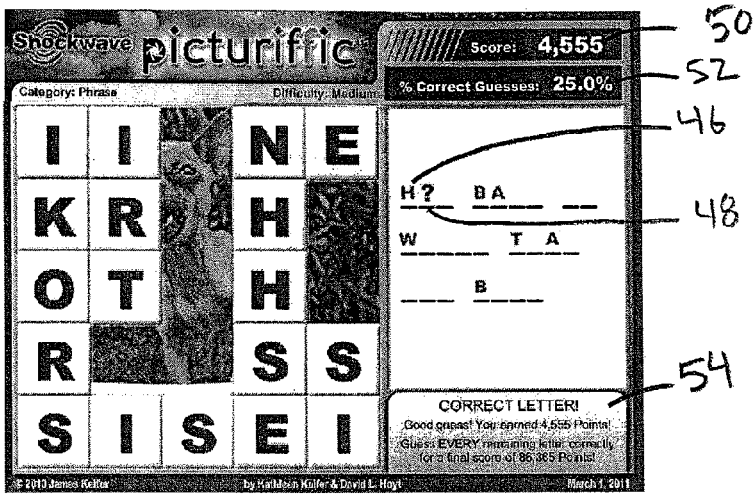
FIG. 5 shows a puzzle game in accordance with an embodiment of the present invention as the game continues.

The player then selects the letter H in FIG. 5, which is the correct selection. The letter H is displayed over the first blank 46, replacing the question mark 30, which moves to the next available blank 48. Points 50 are scored for the correct selection and shown on the puzzle 10. The puzzle 10 also indicates the percentage 52 of correct answers, in this case one out of four or 25%. In the preferred embodiment, the highest score is 100,000 points, so a banner is displayed showing how many points are still available if all the correct selections are made until the end of the game. Other information can be included in the banner 52, such as "CORRECT LETTER" or "GOOD JOB", etc. The banner 52 can also indicate if an incorrect letter was selected.

Figure 6:
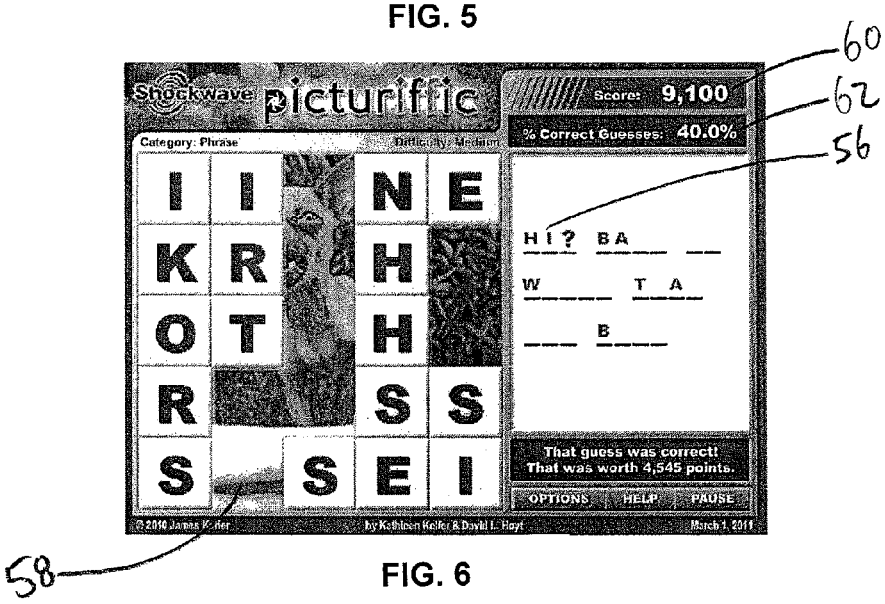
FIG. 6 shows a puzzle game in accordance with an embodiment of the present invention as the game continues.
Figure 7:
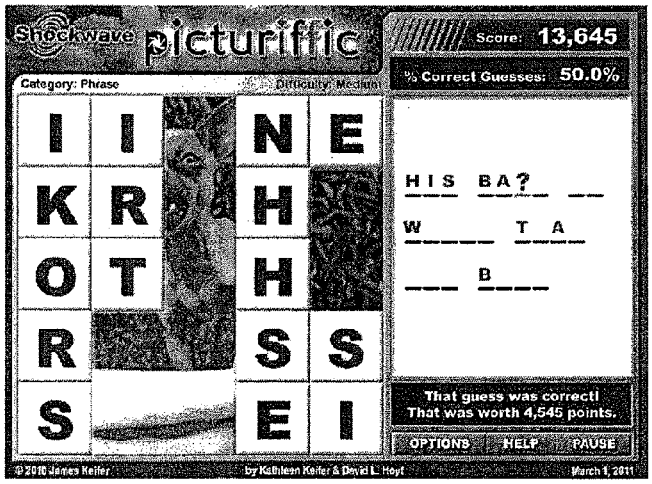
FIG. 7 shows a puzzle game in accordance with an embodiment of the present invention as the game continues.
Figure 8:
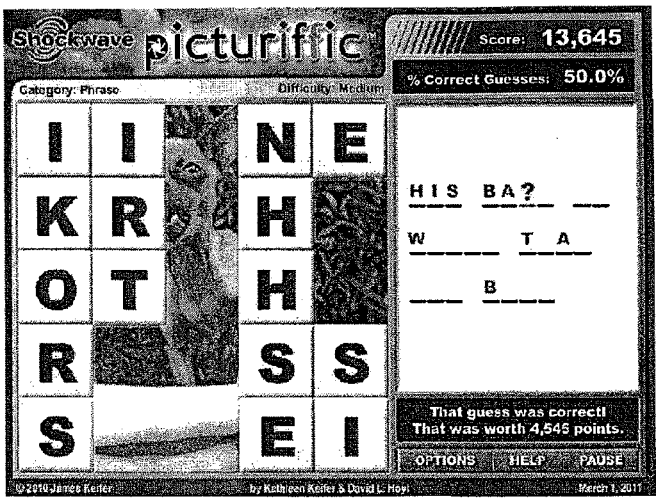
FIG. 8 shows a puzzle game in accordance with an embodiment of the present invention as the game continues.
Figure 9:
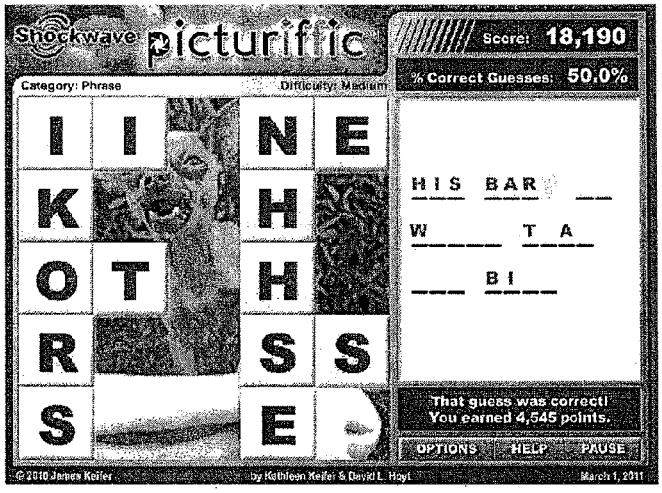
FIG. 9 shows a puzzle game in accordance with an embodiment of the present invention as the game continues.
Figure 10:
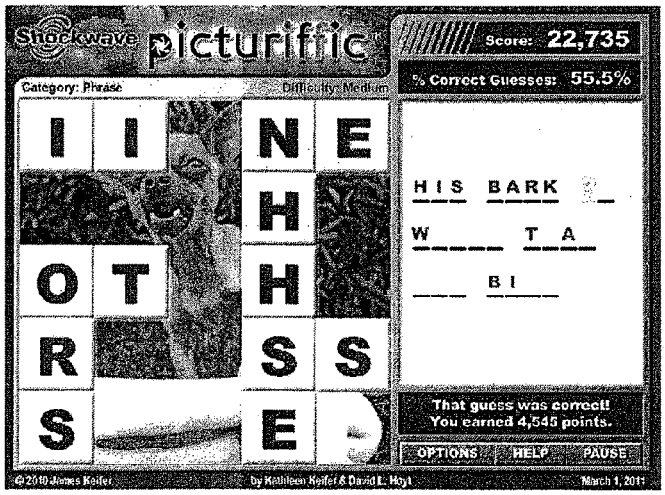
FIG. 10 shows a puzzle game in accordance with an embodiment of the present invention as the game continues.
Figure 11:
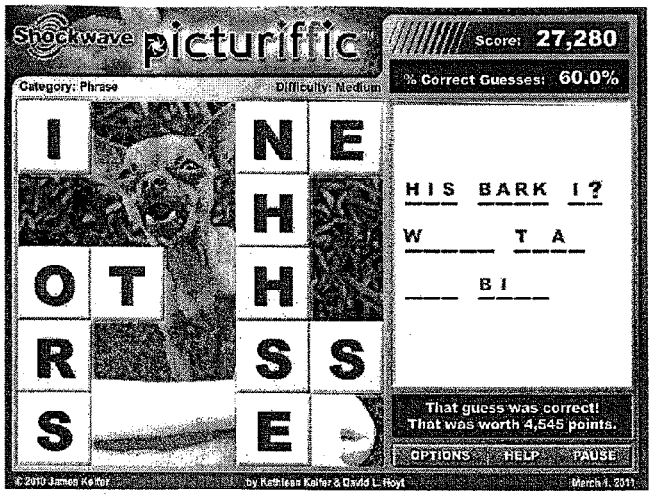
FIG. 11 shows a puzzle game in accordance with an embodiment of the present invention as the game continues.
Figure 12:
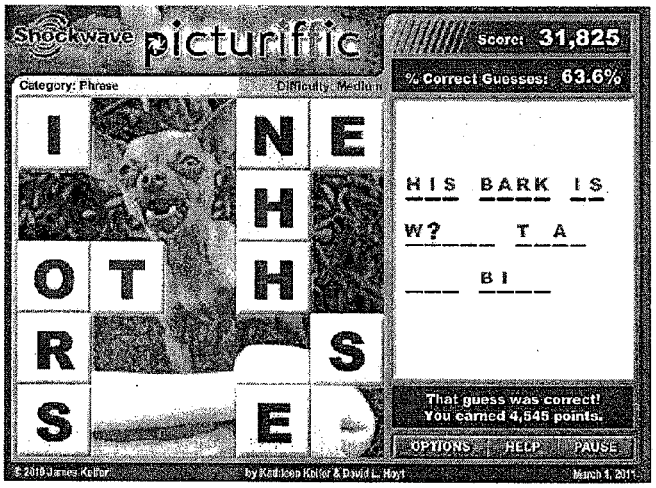
FIG. 12 shows a puzzle game in accordance with an embodiment of the present invention as the game continues.
Figure 13:
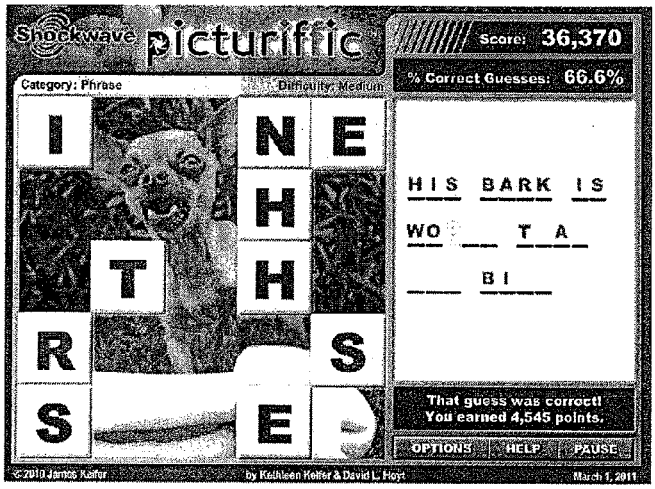
FIG. 13 shows a puzzle game in accordance with an embodiment of the present invention as the game continues.
Figure 14:
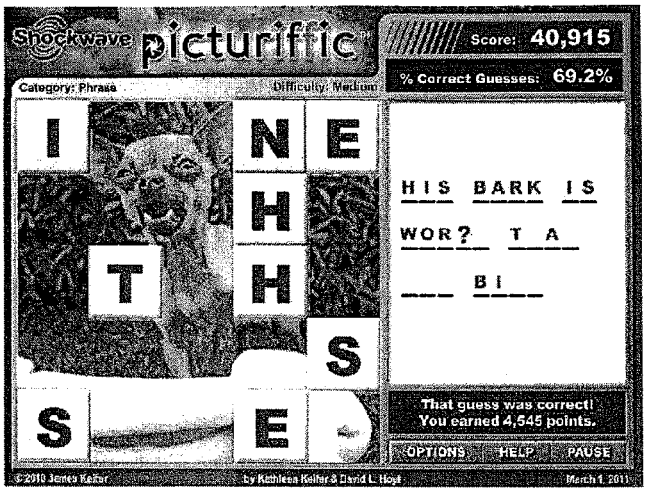
FIG. 14 shows a puzzle game in accordance with an embodiment of the present invention as the game continues.
Figure 15:
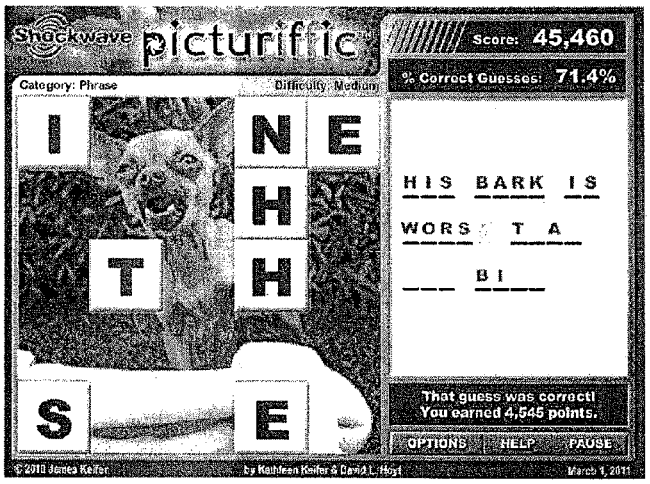
FIG. 15 shows a puzzle game in accordance with an embodiment of the present invention as the game continues.
Figure 16:
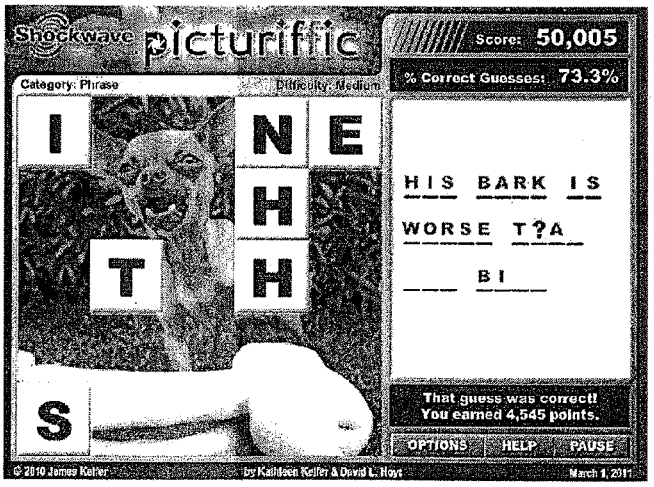
FIG. 16 shows a puzzle game in accordance with an embodiment of the present invention as the game continues.
Figure 17:
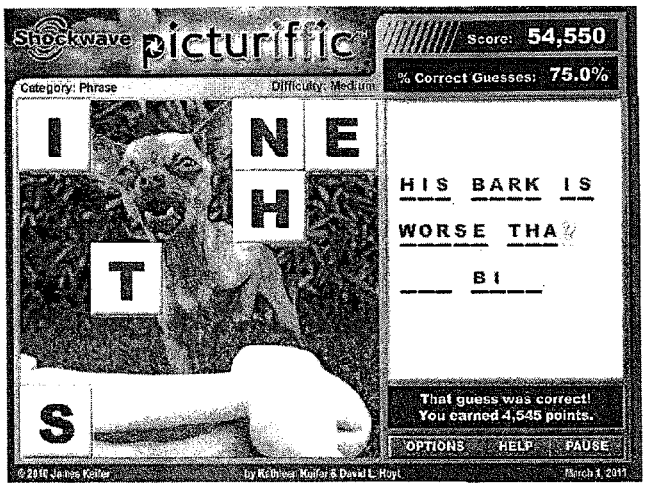
FIG. 17 shows a puzzle game in accordance with an embodiment of the present invention as the game continues.
Figure 18:
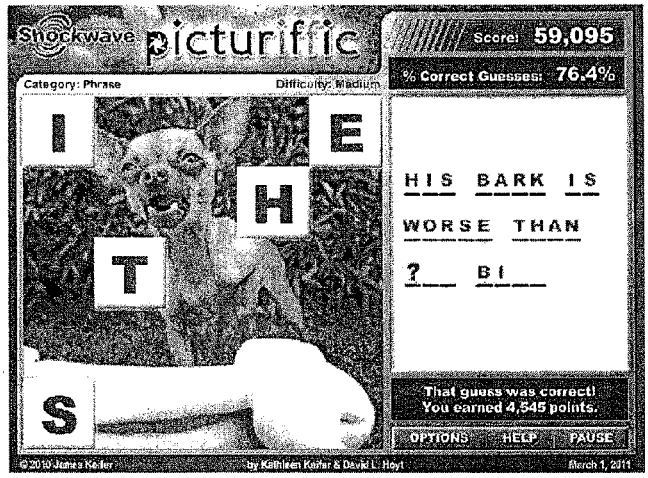
FIG. 18 shows a puzzle game in accordance with an embodiment of the present invention as the game continues.
Figure 19:
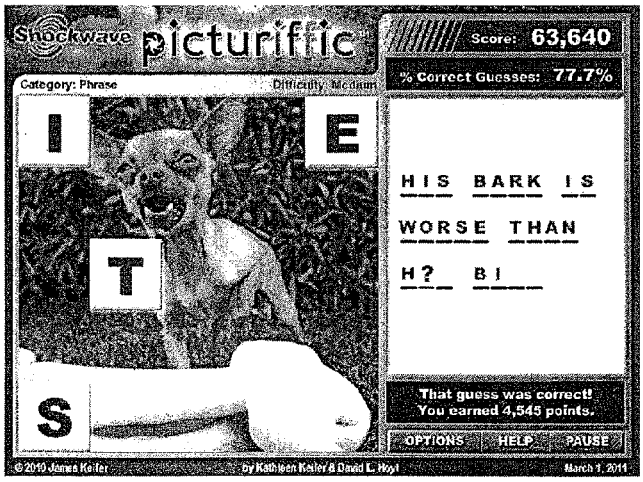
FIG. 19 shows a puzzle game in accordance with an embodiment of the present invention as the game continues.
Figure 20:
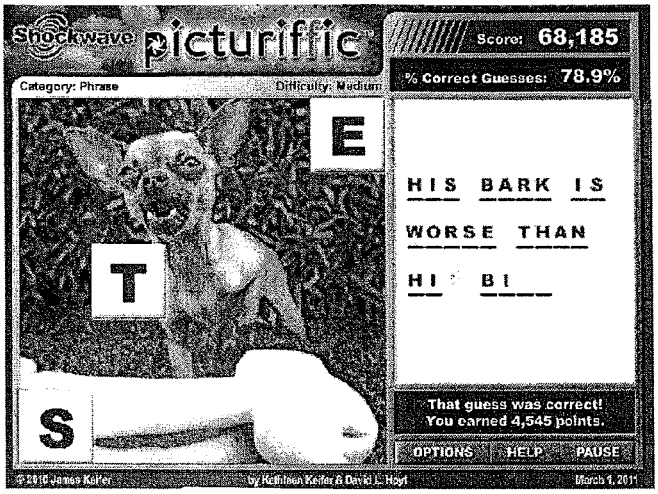
FIG. 20 shows a puzzle game in accordance with an embodiment of the present invention as the game continues.
Figure 21:
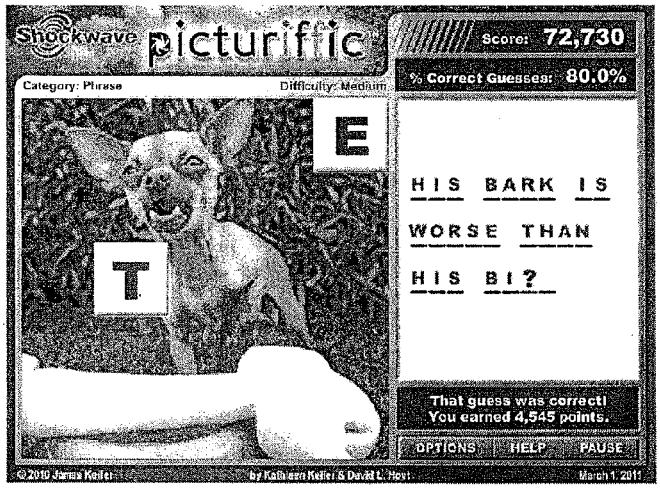
FIG. 21 shows a puzzle game in accordance with an embodiment of the present invention as the game continues.
Figure 22:
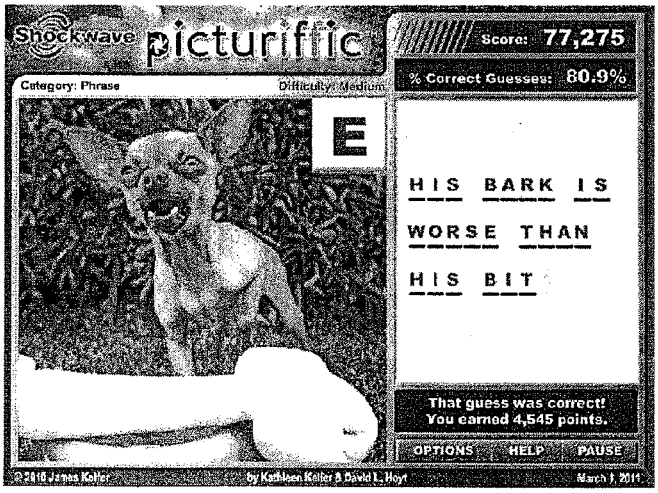
FIG. 22 shows a puzzle game in accordance with an embodiment of the present invention as the game continues.

FIG. 6 shows the correct selection of the letter I and the corresponding portion 58 of the image 12. Total points 60 are accumulated, along with the changing percentage of correct selections 62. FIG. 7 displays the correct selection of the letter S, with the placement of the letter S and the portion of the image 12 shown.

FIGS. 8 through 23 show the correct selections of the letters R, K, I, S, O, R, S, E, H, N, H, I, S, T, and E respectively. The image 12 is further revealed for each selection, whether it is correct or incorrect. FIG. 23 displays the entire image 12 along with the correct mystery answer 22, and the total score 64 and percentage of correct selections 66. Another banner can be displayed indicating the completion of the game, such as "NICE WORK" 68. FIG. 24 shows the game providing a "game summary" 70 and asking if the player wants to play again 72.

The example in FIGS. 1 through 24 with the mystery answer 22 "HIS BARK IS WORSE THAN HIS BITE" is that of a puzzle game 10 in which only letters are used to make up the mystery answer 22. As previously discussed however, numbers can also be part of the mystery answer 22.

Figure 25:
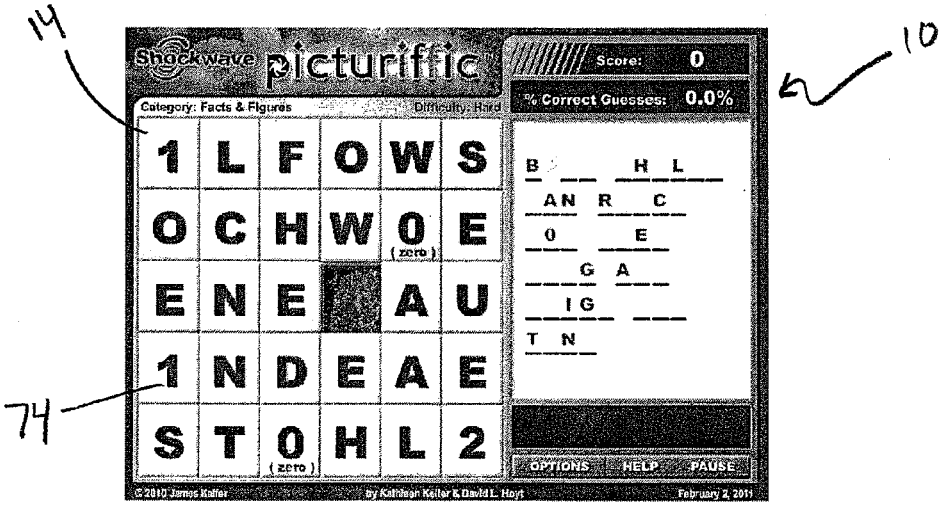
FIG. 25 shows a puzzle game in accordance with an embodiment of the present invention at the beginning of the game.
Figure 26:
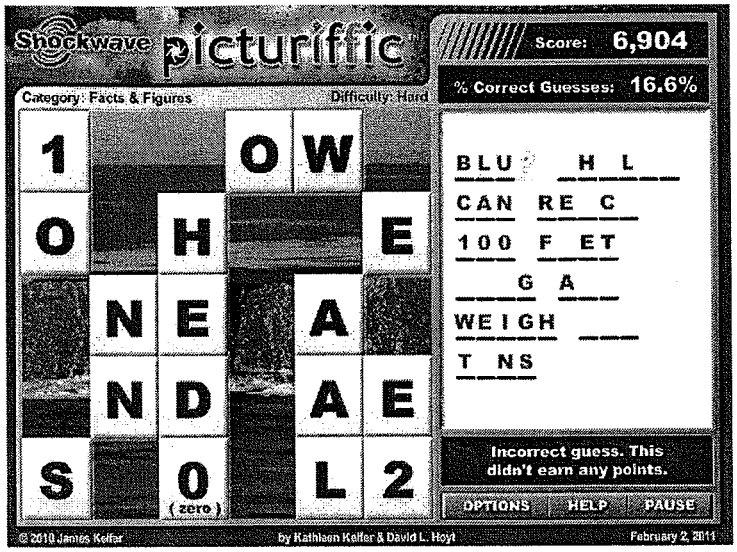
FIG. 26 shows a puzzle game in accordance with an embodiment of the present invention part of the way through the game play.
Figure 27:
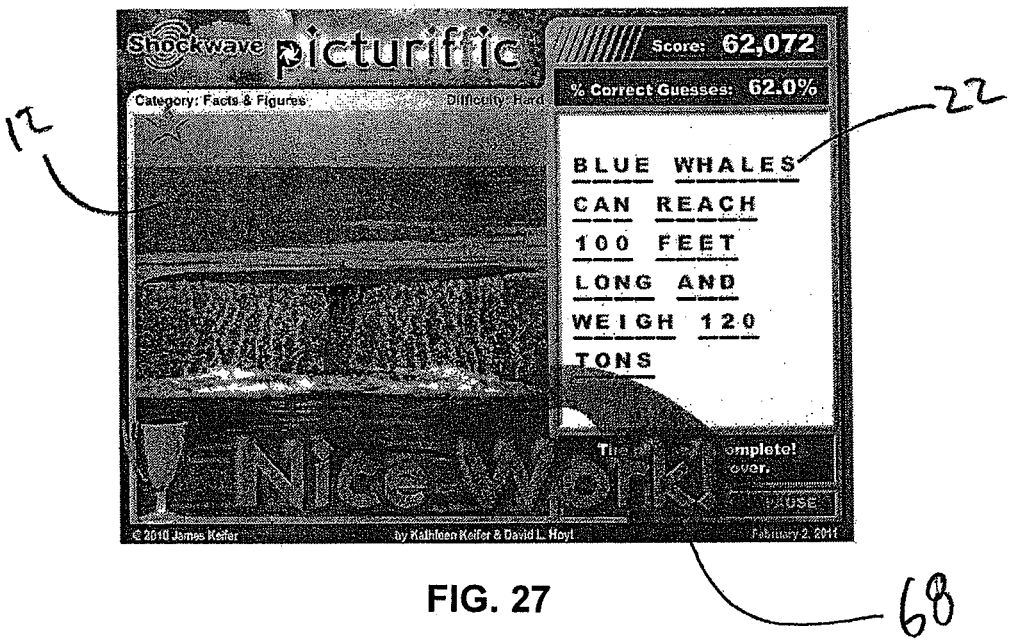
FIG. 27 shows a puzzle game in accordance with an embodiment of the present invention as the game finishes.

FIGS. 25 through 27 display an example of a puzzle game 10 in accordance with the present invention in which numbers are incorporated into the mystery answer 22 and broken up and scrambled on top of the image 12. FIG. 25 displays the start of the game in which the letter grid 14 contains numbers 74. the player selects numbers 74 similar to the way letters 24 are selected. FIG. 26 displays the puzzle game 10 about half way through with additional numbers 74 and letters 24 in the correct locations and additional portions of the image 12 displayed. Finally, FIG. 27 shows the completed mystery answer 22, with the complete image 12 and the "NICE WORK" banner 68.

As described above, a time element can be added to the puzzle game 10. Although not a necessity, adding a time element speeds up the play and changes scoring such that no points are provided if the player does not finish in the allotted time. Also, game play can be altered with a time element. For example, if a player has not made a selection after a certain amount of time, the game could automatically fill in a letter in the mystery answer 22. Thus, there are other ways in which a time element could be added to the present invention.

Two-player puzzle games 10 in accordance with the present invention can be implemented in which one player makes a selection and then the next player makes a selection. One variation would be to have players alternate their guesses but when a player makes a correct selection, the player continues to make selections. Thus, there are a number of different ways to play the puzzle game 10 with two or more players.

Figure 28:
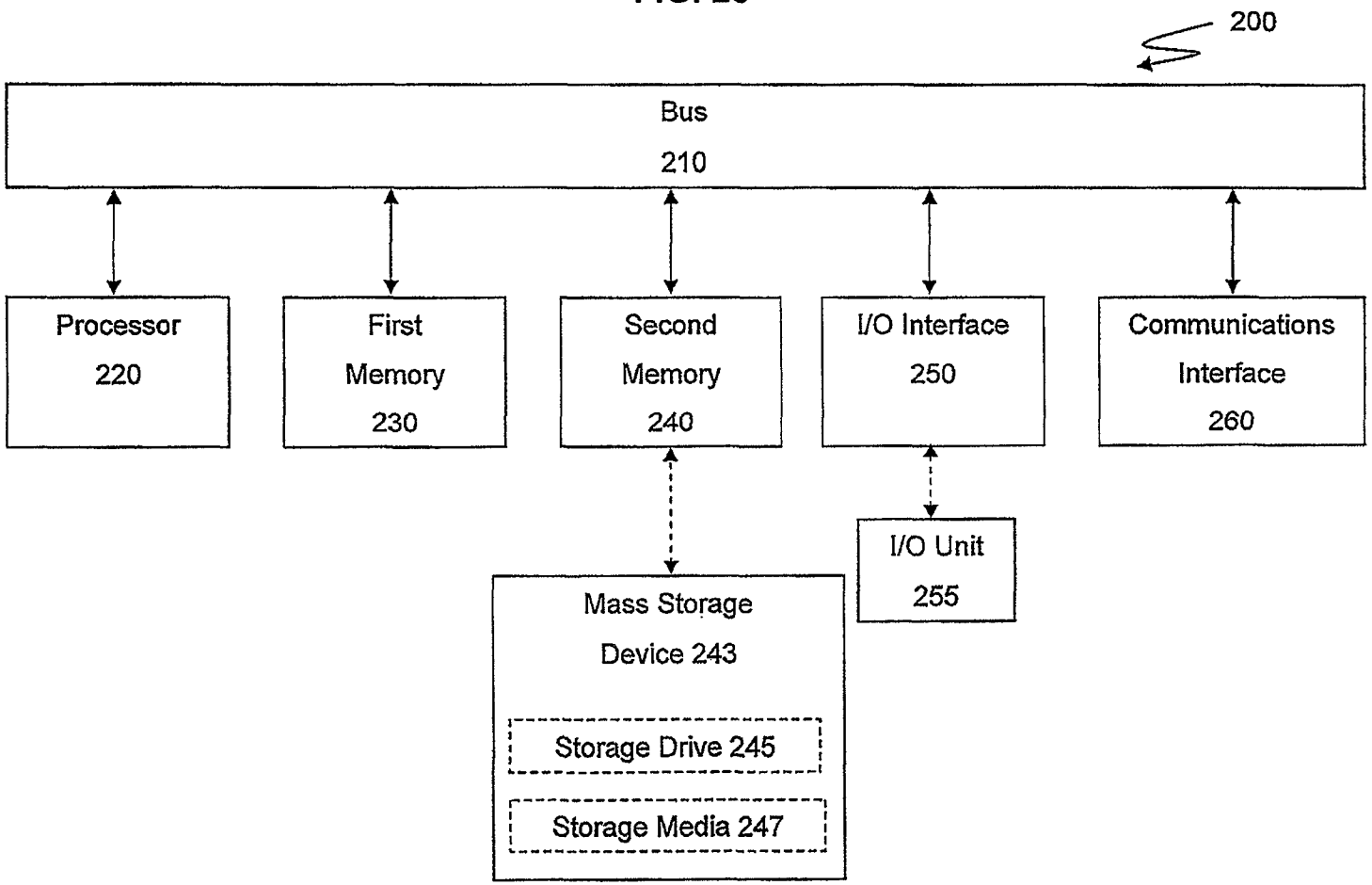
FIG. 28 shows an exemplary computer system according to the present invention.

FIG. 28 illustrates an exemplary computer system 200, or network architecture, that may be used to implement the system and methods according to the present invention. One or more computer systems 200 may carry out the methods presented herein as computer code. One or more processors, such as processor 220, which may be a special purpose or a general-purpose processor is connected to a bus 210. As shown in FIG. 28, bus 210 connects the processor 220 to various other components of the computer system 200, but it is contemplated bus 210 may connect processor 220 to components (not shown) such as, sensors, and servomechanisms. It is also contemplated that bus 210 connects the processor 220 to other computer systems. Via the bus 210, the processor 220 can receive computer code. The term "computer code" includes, for example, programs, instructions, signals and/or data. The processor 220 executes computer code and may further send the computer code via the bus 210.

Computer system 200 may include one or more memories, such as first memory 230 and second memory 240. It is contemplated that the fist memory 230, secondary memory 240, or a combination thereof function as a computer usable storage medium to store and/or access computer code. The first memory 230 and second memory 240 may be, for example, random access memory (RAM), read-only memory (ROM), a mass storage device, or any combination thereof.

As shown in FIG. 28, one embodiment of second memory 240 is a mass storage device 243, although it is contemplated that first memory 230 may be the mass storage device. The mass storage device 243 comprises a storage drive 245 and a storage media 247. It is contemplated the storage media 247 may or may not be removable from the storage drive 245. Mass storage devices 243 with storage media 247 that are removable, otherwise referred to as removable storage media, allow computer code to be transferred to and/or from the computer system 200.

A mass storage device 243 may include, for example, a Compact Disc Read-Only Memory ("CDROM"), ZIP storage device, tape storage device, magnetic storage device, optical storage device, Micro-Electro-Mechanical Systems ("MEMS"), nanotechnological storage device, floppy storage device, hard disk device. Mass storage device 243 also includes program cartridges and cartridge interfaces (such as that found in video game devices), removable memory chips (such as an EPROM, or PROM) and associated sockets.

The computer system 200 may further or alternatively include other means for computer code to be loaded into or removed from the computer system 200, for example, input/output ("I/O") interface 250 and/or communications interface 260.

Both the I/O interface 250 and the communications interface 260 allow computer code to be transferred between the computer system 200 and external devices including other computer systems. This transfer may be bi-directional or omni-direction to or from the computer system 200.

Computer code transferred by the I/O interface 250 and the communications interface 260 are typically in the form of signals, which may be electronic, electromagnetic, optical, or other signals capable of being sent and/or received by the interfaces. These signals may be transmitted via a variety of modes including, but not limited to, wire or cable, fiber optics, a phone line, a cellular phone link, infrared ("IR"), and radio frequency ("RF") link.

The I/O interface 250 may be any connection, wired or wireless, that allows the transfer of computer code. An I/O interface 250 includes, for example, an analog or digital audio connection, digital video interface ("DVI"), video graphics adapter ("VGA"), musical instrument digital interface ("MIDI"), parallel connection, PS/2 connection, serial connection, universal serial bus connection ("USB"), IEEE1394 connection, PCMCIA slot and card. In certain embodiments the I/O interface connects to an I/O unit 255 such as a user interface, monitor, speaker, printer, touch screen display, to name a few.

The communications interface 260 is also any connection that allows the transfer of computer code. Communication interfaces include, but are not limited to, a modem, network interface (such as an Ethernet card), wired or wireless systems (such as Wi-Fi, Bluetooth, IR), local area networks, wide area networks, intranets, etc.

The invention is also directed to computer products, otherwise referred to as computer program products, to provide software that includes computer code to the computer system 200. Processor 220 executes the computer code in order to implement the methods of the present invention. As an example, the methods according to the present invention may be implemented using software that includes the computer code, wherein the software is loaded into the computer system 200 using a memory 230, 240 such as the mass storage drive 243, or through an I/O interface 250, communications interface 260, or any other interface with the computer system 200. The computer code in conjunction with the computer system 200 described herein may perform any one of, or any combination of, the steps of any of the methods presented herein. It is also contemplated that the methods according to the present invention may be performed automatically, or may be invoked by some form of manual intervention.

The computer system 200, or network architecture, of FIG. 28 is provided only for purposes of illustration, such that the present invention is not limited to this specific embodiment. It is appreciated that a person skilled in the relevant art knows how to program and implement the invention using any computer system or network architecture.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A method for providing a puzzle game containing letters in a letter grid, a category clue, an answer grid, a mystery answer and an image, said image being hidden beneath the letters in the letter grid, comprising a network server, a microprocessor, a memory and computer software, said computer software being located in said memory and run by said microprocessor, said computer software comprising a puzzle game algorithm, wherein said puzzle game algorithm comprises the steps of:

a. displaying the puzzle game on a screen of an electronic device;

b. allowing a player to select a first letter from the letter grid;

c. displaying the first selected letter in the correct location on the answer grid corresponding to the mystery answer;

d. removing the first selected letter from the letter grid to display an additional portion of the image;

e. allowing said player to select a next letter from the letter grid;

f. displaying the next selected letter in the correct location on the answer grid corresponding to the mystery answer;

g. removing the next selected letter from the letter grid to display an additional portion of the image;

h. repeating steps e through g until there are no more letters to be selected.

2. The method for providing a puzzle game in claim 1, wherein points are accumulated if the selected letter corresponds to the first available location on the answer grid.

3. The method for providing a puzzle game in claim 2, wherein points are accumulated if the selected letter corresponds to an available location on the answer grid.

4. The method for providing a puzzle game in claim 3, wherein said points accumulated if the selected letter corresponds to the first available location on the answer grid are greater than said points accumulated if the selected letter corresponds to an available location on the answer grid.

5. The method for providing a puzzle game in claim 1, wherein said puzzle game is ended if said letter selected does not correspond to said first available location on said answer grid a predefined number of times.

6. The method for providing a puzzle game in claim 1, wherein accumulated points are reduced if said selected letter does not correspond to said first available location on said answer grid.

7. The method for providing a puzzle game in claim 1, wherein when said letter is selected, a banner is displayed on the screen.

8. The method for providing a puzzle game in claim 7, wherein if said selected letter corresponds to said first available location on said answer grid, the banner indicates that a correct letter was selected.

9. The method for providing a puzzle game in claim 1, wherein said image is partially hidden beneath the letters in the letter grid.

10. The method for providing a puzzle game in claim 1, wherein said electronic device is one of a laptop computer, a computer tablet, a cellular telephone.

11. A method for providing a puzzle game for two players containing letters in a letter grid, a category clue, an answer grid, a mystery answer and an image, said image being hidden beneath the letters in the letter grid, comprising a network server, a microprocessor, a memory and computer software, said computer software being located in said memory and run by said microprocessor, said computer software comprising a puzzle game algorithm, wherein said puzzle game algorithm comprises the steps of:

a. displaying the puzzle game on a screen of an electronic device;

b. allowing a first player to be a current player and a second player to be a non-current player;

c. allowing said current player to select a letter from the letter grid;

d. displaying the selected letter in the correct location on the answer grid corresponding to the mystery answer;

e. removing the selected letter from the letter grid to display an additional portion of the image;

f. if said selected letter corresponds to a first available location on said answer grid, then allowing said current player to remain a current player and said non-current player to remain a non-current player;

g. if said selected letter does not correspond to said first available location on said answer grid, then allowing said non-current player to become said current player and said current player to become said non-current player;

h. repeating steps c through g until there are no more letters to be selected.

12. The method for providing a puzzle game in claim 11, wherein points are accumulated by said current player if the selected letter corresponds to the first available location on the answer grid.

13. The method for providing a puzzle game in claim 12, wherein points are accumulated by said current player if the selected letter corresponds to an available location on the answer grid.

14. The method for providing a puzzle game in claim 13, wherein said points accumulated if the selected letter corresponds to the first available location on the answer grid are greater than said points accumulated if the selected letter corresponds to an available location on the answer grid.

15. The method for providing a puzzle game in claim 11, wherein said puzzle game is ended and said current player loses the game if said letter selected does not correspond to said first available location on said answer grid a predefined number of times.

16. The method for providing a puzzle game in claim 11, wherein accumulated points by said current player are reduced if said selected letter does not correspond to said first available location on said answer grid.

17. The method for providing a puzzle game in claim 11, wherein when said letter is selected, a banner is displayed on the screen.

18. The method for providing a puzzle game in claim 17, wherein if said selected letter corresponds to said first available location on said answer grid, the banner indicates that a correct letter was selected.

19. The method for providing a puzzle game in claim 11, wherein said image is partially hidden beneath the letters in the letter grid.

20. The method for providing a puzzle game in claim 11, wherein said electronic device is one of a laptop computer, a computer tablet, a cellular telephone.

* * * * *